US006487734B1

(12) United States Patent
First

(10) Patent No.: US 6,487,734 B1
(45) Date of Patent: Dec. 3, 2002

(54) POOL COVER ASSEMBLY

(76) Inventor: William A. First, 705 Langdon Rd., Erie, PA (US) 16509

( * ) Notice: Subject to any disclaimer, the term of this patent is extended or adjusted under 35 U.S.C. 154(b) by 0 days.

(21) Appl. No.: 09/934,322

(22) Filed: Aug. 22, 2001

(51) Int. Cl.[7] ..... E04H 4/06
(52) U.S. Cl. ..... 4/498; 4/503
(58) Field of Search ..... 4/498, 503

(56) References Cited

U.S. PATENT DOCUMENTS

| | | | | | |
|---|---|---|---|---|---|
| 2,964,759 | A | | 12/1960 | Riggs | 4/172 |
| 3,148,384 | A | | 9/1964 | Bartolucci et al. | 4/172 |
| 3,534,412 | A | * | 10/1970 | Crook | 4/498 X |
| 3,769,639 | A | * | 11/1973 | Bishop | 4/498 |
| 4,122,562 | A | | 10/1978 | Sorrentino | 4/172 |
| 4,182,086 | A | | 1/1980 | Crooks | 52/81 |
| RE30,774 | E | * | 10/1981 | Dahlbeck et al. | 4/198 |
| 4,951,327 | A | | 8/1990 | Del Gorio, Sr. | 4/498 |
| 5,303,527 | A | | 4/1994 | Perez et al. | 52/632 |
| 5,371,907 | A | * | 12/1994 | Horvath | 4/498 |
| 5,687,432 | A | * | 11/1997 | Genzel | 4/498 |
| 5,970,531 | A | | 10/1999 | Demby | 4/498 |
| 6,119,284 | A | * | 9/2000 | Cosman | 4/498 |
| 6,272,695 | B1 | * | 8/2001 | Brandner | 4/498 |
| 6,381,767 | B1 | * | 5/2002 | Brashears | 4/498 |

* cited by examiner

*Primary Examiner*—Charles E. Phillips
(74) *Attorney, Agent, or Firm*—Wayne L. Lovercheck

(57) ABSTRACT

A pool cover assembly for covering for covering an above ground swimming pool during periods of non-seasonal use includes a plurality of pool cover brackets arranged about and on the railing of the swimming pool with each pool cover bracket including a hook for engaging the inner lip of the railing and a socket member which projects inwardly, and at an acute angle, toward the swimming pool in order to receive the ends of pole cover supporting beams whereupon each supporting beam will extend across and above the swimming pool for securement to oppositely arranged pairs of brackets thereby forming a cambered framework that supports a pool cover above and around the swimming pool. Each pool cover bracket also includes a ring secured adjacent the hook, and to which the end of a thrust reduction member, such as an elongate metal rod, is attached so that each thrust reduction member can be attached to oppositely arranged pairs of pool cover brackets in order to alleviate the lateral and horizontally directed force of the ends of the supporting beams, and the weight of any debris accumulated on the pool cover, against the sidewall of the swimming pool.

25 Claims, 4 Drawing Sheets

POOL COVER ASSEMBLY

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention pertains to pool cover supporting systems, and, more particularly, pertains to a pool cover assembly primarily for use with above ground swimming pools to cover the swimming pool during periods of non-seasonal use in order to prevent debris from collecting on or in the pool and thereby marring the quality of the pool water and physically damaging the swimming pool.

The past two decades have seen a dramatic rise in the popularity of backyard swimming pools of both the in ground and above ground type. Their popularity is due to a number of factors including: the wide range of designs, configurations, and sizes available for both types of swimming pools; the sophistication and efficiency of the pumps and filtration systems; the convenience and safety afforded to families, especially families that have small children that cannot be dropped off and left unsupervised at public community swimming pools; the variety of adjunct equipment available such as ladders and slides; and the high quality of construction materials combined with the cost reasonability of most types of swimming pools. In addition, the aesthetic quality of both types of swimming pools can be enhanced by elaborately designed decks.

Both above ground and in ground swimming pools require substantial maintenance during the peak summer swimming season, with a particular emphasis on the daily monitoring of pool water quality. However, maintenance is also required in opening the pool during the spring preparation period and in closing the pool during the fall shutdown period. The most important step in closing the pool, after cleaning and bringing indoors the pump and filtration system, is covering the swimming pool with some kind of tarp that should ideally close off the swimming pool from the exterior environment. If either type of swimming pool were left open and uncovered year round all manner of debris—leaves, twigs, branches, dead insects, dirt, ice, snow would collect in the swimming pool impairing, and perhaps destroying, pool water quality as well as tearing and possibly ruining the lining and sidewall of the swimming pool necessitating costly repairs.

Therefore, in order to sustain the life of the swimming pool the post-swimming season closing process includes placing a pool cover of a tarpaulin material over the swimming pool. Standard tarps for above ground pools are sized to fit over the edges of the sidewall and include a peripheral nylon or flexible metal wire that is tightened by a hand operable ratchet device. A flotation device can be tied to the railing of the sidewall, and is then floated out to the middle of the pool for spacing the pool cover above the surface of the water to prevent a depression from forming in the middle of the pool. Such a depression will collect the aforementioned debris, and the accumulated weight will cause untoward strain on the sidewall and the durable but fragile pool liner. Invariably, the flotation device will shift in position, and over the course of winter deflate, thereby allowing the pool cover to sag thus thwarting the intentions of the pool owner. The pool cover is too difficult to remove, especially upon the arrival of the winter season, and is simply left on until spring removal despite the loss of shape and effectiveness.

Thus, the prior art discloses a number of different types of pool cover systems and structures for both in-ground and aboveground pools.

With respect to in-ground swimming pools, the Riggs Patent (U.S. Pat. No. 2,964,759) discloses a frame pool cover having arched members which span the length of the pool, and which attach to side members that engage the pool edge overhang. Side members assist in maintaining the disposition of the arched members, and are secured in position by braces that are screwed into the concrete edge of the pool.

The Bartolucci et al. patent (U.S. Pat. No. 3,148,348) discloses a pool cover which includes a cover that must be unrolled from a spindle and which is permanently secured to the pool by socket elements embedded into the pool edge.

The Perez et al. Patent (U.S. Pat. No. 5,303,527) discloses a pool cover apparatus that includes a plurality of frame members that span the pool and are partially submerged in the pool, and at least one support column that rests on the pool bottom for supporting the frame members.

The Demby Patent (U.S. Pat. No. 5,970,531) discloses a modular pool cover frame that includes wooden A-frame assemblies that span the swimming pool, and upon which a pool cover is draped.

With respect to aboveground swimming pools, Serrentino (U.S. Pat. No. 4,122,562) discloses a support frame that includes tubular uprights spaced about the swimming pool sidewall, and the uprights support a central frame that is spaced above the pool and from which an inflatable device is pendent.

The Del Gorio Sr. Patent (U.S. Pat. No. 4,951,337) discloses a pool cover support system that includes a central support member extending upwardly from the pool bottom that supports a plurality of radial support arms that mount to the upper edge of the sidewall at their distal end.

Nonetheless, despite the variety of pool cover systems and structures, there remains a need for a pool cover system or structure that is simple and easy to dispose on the swimming pool, maintains its shape and integrity throughout its period of disposition, and does not produce undue strain on or against the sidewall and liner of the aboveground swimming pool.

BRIEF SUMMARY OF THE INVENTION

The present invention comprehends a pool cover assembly for covering an aboveground swimming pool during periods of non-use.

The pool cover assembly includes a plurality of pool cover brackets that are arranged on, and removably mountable to, a cover plate or railing of the swimming pool sidewall. Each pool cover bracket includes a base portion that is superposed on the railing or cover plate, a hook that extends downwardly from the base portion for engaging the inner lip of the railing of the sidewall, a socket member that projects upwardly from, and at an acute angle to, the base portion, and a ring that projects inwardly from the hook in the same direction as the socket member. The brackets are arranged about the sidewall of the swimming pool so that one pair of brackets is generally disposed opposite of each other on the swimming pool.

The pool cover is supported above and around the swimming pool by a plurality of elongated pool cover supporting beams, and each supporting beam extends across and spans the swimming pool so that the opposed ends of each respective supporting beam can be slidably inserted into the socket members of each pair of oppositely mounted brackets. The socket members have an internal cavity with curved ends and straight sides. The opposed ends of the supporting beams slide snugly between the sides which positions the beam, the elongate cavity permits a range of entry angle allowing for the fit of the supporting beams between the socket members.

When disposed in their operative position, the supporting beams form an arched or cambered structure over the swimming pool for supporting the pool cover. In addition, the pool cover assembly includes at least one thrust reduction member for lessening the strain and outwardly directed force against the upper end of the sidewall from the supporting beams and the debris that has accumulated on the pool cover. The thrust reduction members can include flexible metal coils each of which will extend between, and be secured to the rings of one pair of pool cover brackets oppositely mounted on the sidewall. The flexible coils will span the swimming pool slightly above the water surface and will tend to counteract the strain and outwardly directed horizontal thrust of the beams and load from the debris that has accumulated on the pool cover.

It is an object of the present invention is to provide a pool cover assembly that is lightweight and easy to assemble and disassemble.

It is another object of the present invention is to provide a pool cover assembly that is capable of being configured to fit onto and cover round, square, rectangular, and other such non-standard shaped swimming pools.

Yet another object of the present invention is to provide a pool cover assembly that can fully cover a swimming pool but does not require permanent mounting to the swimming pool and does not require any alteration or modification of any structural parts of the swimming pool.

Still another object of the present invention is to provide a pool cover assembly that provides structural elements that can alleviate and counteract any strain and outwardly directed force that may result from the disposition of the supporting beams in the brackets and load from the debris that may accumulate on the pool cover.

The above, and other objects, features and advantages of the present invention will become apparent from the following description when read in conjunction with the accompanying drawings, in which like reference numerals designate the same elements.

BRIEF DESCRIPTION OF THE SEVERAL VIEWS OF THE DRAWING(S)

DETAILED DESCRIPTION OF THE INVENTION

Figure 1:
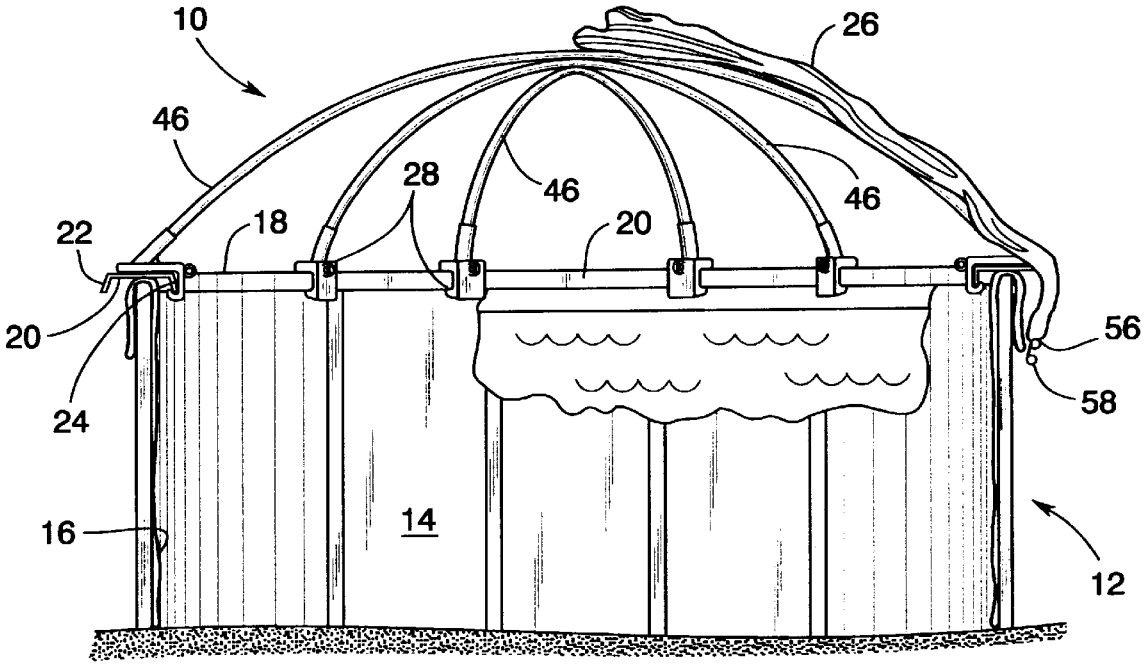
FIG. 1 is a side elevational view of the preferred embodiment of the present invention.
Figure 2:
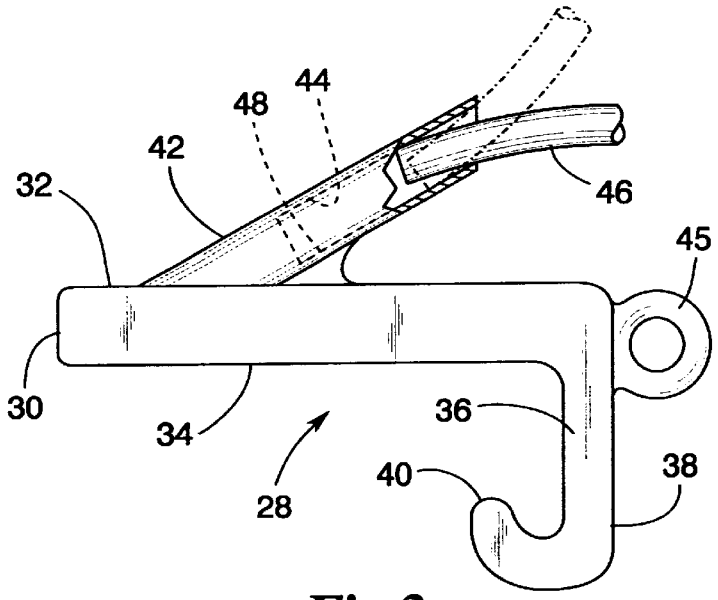
FIG. 2 is a side elevational view of a pool cover bracket first shown in FIG. 1 illustrating several entry angles for the end of a supporting pole.
Figure 3:
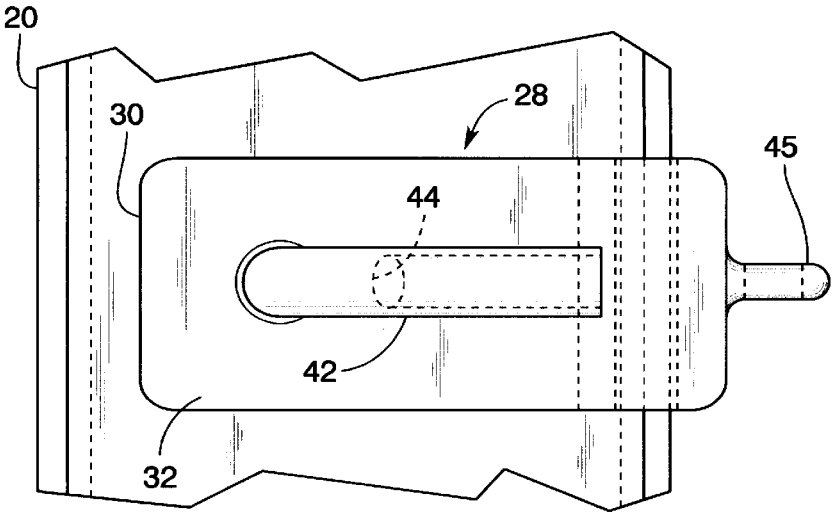
FIG. 3 is a top plan view of a pool cover bracket first shown in FIG. 1 illustrating the mounting of the pool cover bracket to the railing of the swimming pool sidewall.
Figure 3A:
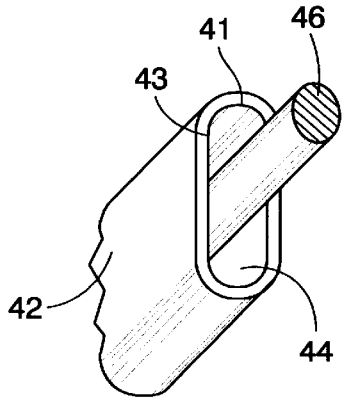
FIG. 3A is an enlarged end view of the socket member of the pool cover support members/brackets showing the straight directing sides of the cavity.
Figure 4:
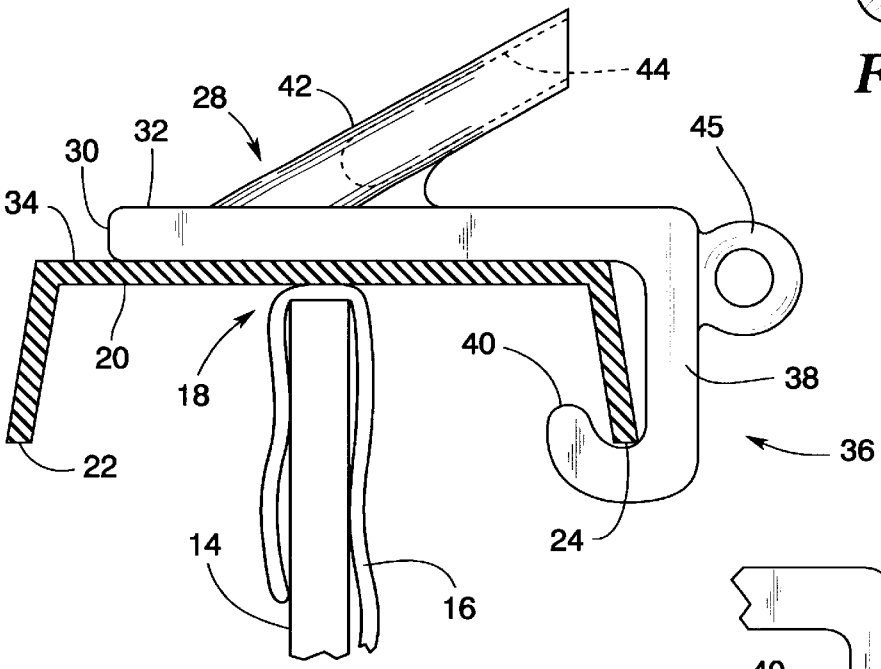
FIG. 4 is an enlarged side elevational view of the pool cover bracket illustrating its mounting to the railing of the swimming pool sidewall.

Illustrated in FIGS. 1 through 8 is pool cover assembly 10 for placement on a swimming pool, with particular usefulness for an above ground swimming pool 12 as shown in FIG. 1. Above ground swimming pools may have many different sizes and geometric configurations; pool 12 shown in FIGS. 1, 3 and 4 is typical insofar as it includes sidewall 14 which supports liner 16 that is contiguously disposed against sidewall 14. Liner 16 is folded over upper edge 18 of sidewall 14 and held in place by the securement of a horizontally extending cover plate or railing 20 to upper edge 18 of sidewall 14. Cover plate or railing 20 has an exterior overhang or lip 22 and an interior overhang or lip 24. As will be more fully described hereinafter, pool cover 26 will be draped over the entire swimming pool 12, and the peripheral edge of pool cover 26 will be drawn tight against and underneath exterior lip 22 of railing 20 for securing pool cover 26 (shown partially unfolded in FIG. 1) to sidewall 14.

Figure 5:
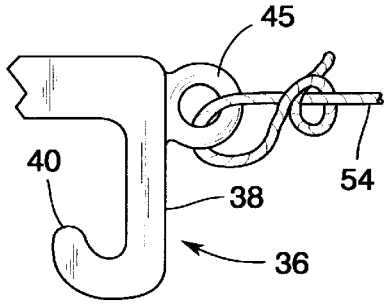
FIG. 5 is a side elevational view of a pool cover bracket first shown in FIG. 1 illustrating the attachment of a thrust reduction member to the ring of the bracket.
Figure 6:
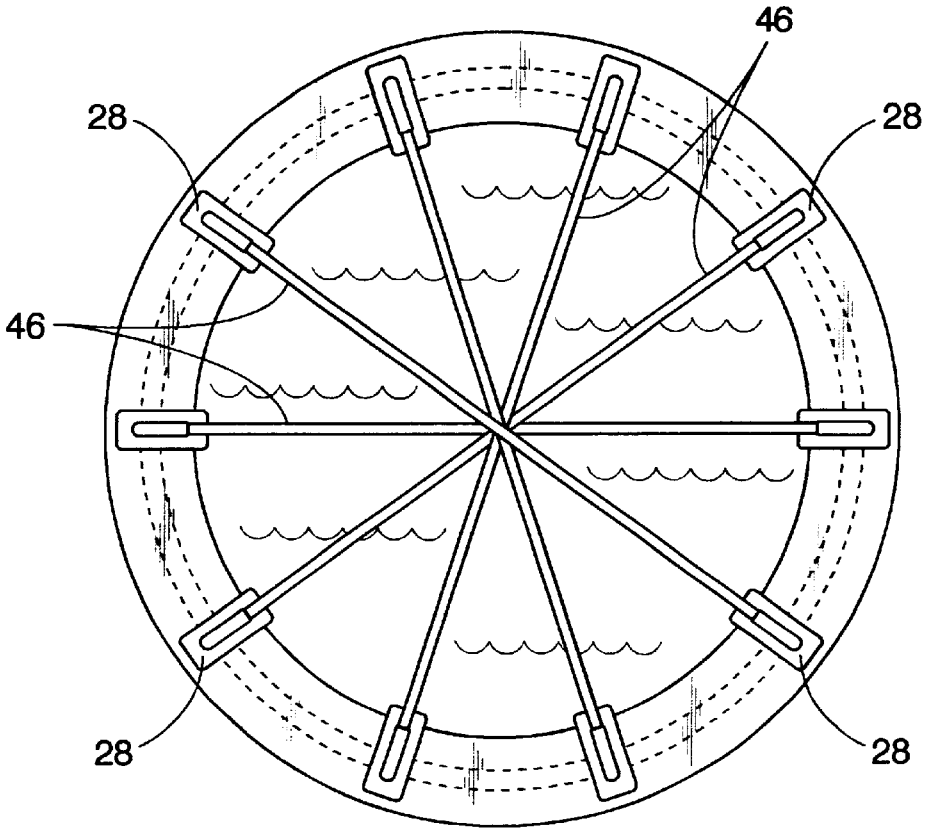
FIG. 6 is a top plan view illustrating one type of arrangement of pool cover brackets and supporting poles to a circular aboveground swimming pool.
Figure 7:
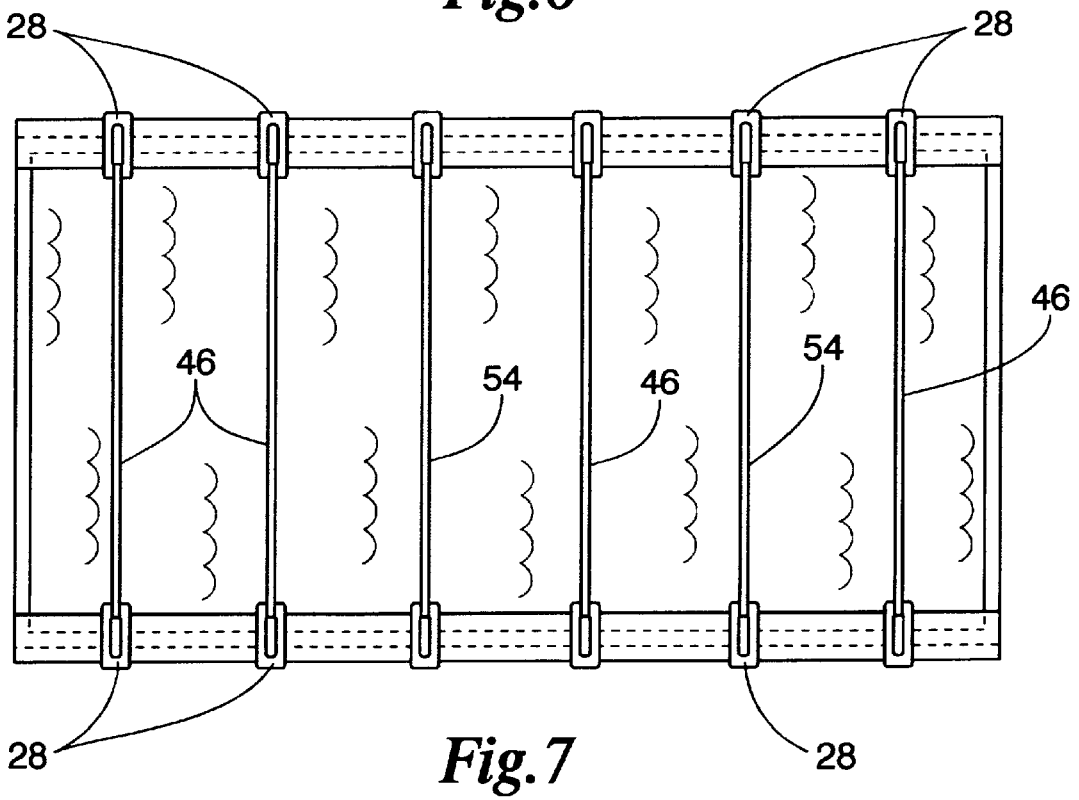
FIG. 7 is a top plan view illustrating one type of arrangement of pool cover brackets and supporting poles to a rectangular-shaped aboveground swimming pool; and, FIG. 8 is a side elevational view of the supporting poles first shown in FIG. 1 illustrating the links that constitute each supporting pole.

As illustrated in FIGS. 1 through 7, pool cover assembly 10 includes a plurality of pool cover support members or brackets 28 that are removably mountable to railing 20. Brackets 28 can be arranged about railing 20 in any number of configurations; representative examples are shown in FIGS. 1, 6 and 7. Each bracket 28 includes a number of features that facilitates its easy and simple securement to and removal from railing 20. Each pool cover bracket 28 includes a base portion or platform 30 having an upper surface 32 and an opposite lower surface 34. Lower surface 34 is disposed contiguous to railing 20 when pool cover bracket 28 is mounted onto railing 20. Integrally formed from base portion 30, and projecting downwardly from lower surface 34, is hook 36. Hook 36 comprises straight portion 38 and curvilinear distal end 40. Distal end 40 of each hook 36 is configured to engage inner lip 24 in order to secure pool cover bracket 28 to railing 20, and distal end 40 is designed to be easily disengaged therefrom for lifting and removing each pool cover bracket 28 from railing 20. Pool cover brackets 28 can be manufactured as a lightweight, durable plastic component.

As illustrated in FIGS. 1 through 4, each pool cover bracket 28 includes socket member 42 that projects upwardly from upper surface 32 of base portion 30, and at an acute angel to upper surface 32. Socket member 42 leans or inclines toward hook 36; and, therefore, when each pool cover bracket 28 is mounted to railing 20, each socket member 42 will project or face inwardly toward the center or central area of a swimming pool. Furthermore, each socket member 42 has cavity 44 that extends into socket member 42 and cavity 44 has a depth and diameter sufficient to receive and snugly hold structural elements hereinafter described. Also, each bracket 28 includes a catch or ring 45 that is integrally formed on straight portion 38 of hook 36, and when bracket 28 is mounted to railing 20, hook 36 will project inwardly toward the center or central area of the particular swimming pool.

In order to dispose pool cover 26 over swimming pool 12 and about railing 20, a pool cover supporting means, as shown in FIGS. 1, 2 and 6 through 8, is used for spanning swimming pool 12 and supporting pool cover 26 above and around pool 12. More specifically, the pool cover supporting means includes a plurality of elongated pool cover supporting poles or beams 46. Each supporting pole 46 terminates at opposed socket insertion ends 48. Supporting poles 46 are lightweight, pliable and weather resistant, and for ease and simplicity in disposing supporting poles 46 to their operative position, and also for breaking them down for storage, each supporting pole 46 is actually comprised of a series of interconnected links or segments 50 with each link 50 attached to adjacent links 50 by short elastic cord 52 internally contained within each link 50 and located adjacent one of the ends of each link 50. The opposed ends of each link 50 are dimensioned to either receive or be inserted into the ends of the adjacently connected links 50, and elastic cords 52 do not interfere with the linear assemblage of links 50 to form each supporting pole 46. The interconnected segments or links 50 are similar in form and construction to the several rectilinear pole segments that typically constitute camping tent poles.

Figure 8:
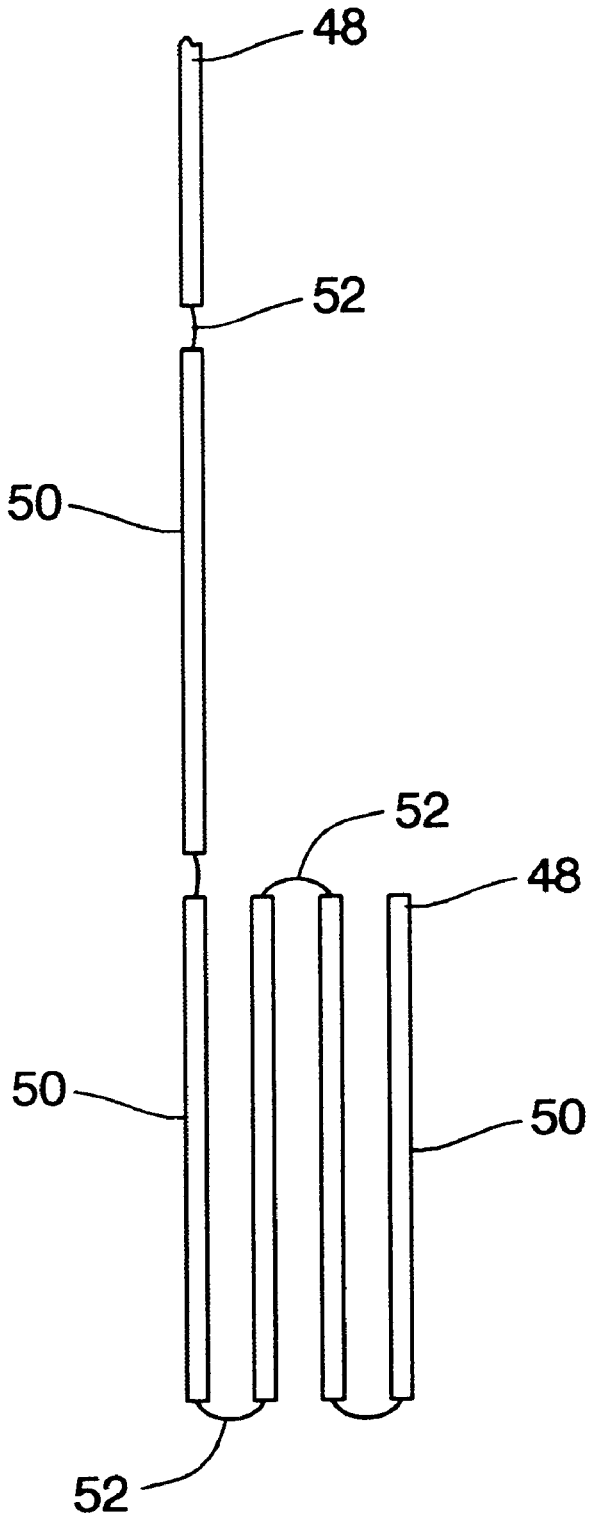

FIG. 8 shows one supporting pole 46 in a partially unfolded disposition. For convenience in manipulating supporting poles 46 to their operative position, and collapsing them for storage, an appropriate link 50 length would be approximately 25 inches, and a useful range of lengths to accommodate the variety of pools on the market would be between 20 and 36 inches.

As shown in FIGS. 5 through 7, at least one, and preferably several, load or thrust reduction members 54 can be attached to respective rings 45 of at least one pair of pool cover brackets 28 that are mounted opposite to each other on railing 20. Thrust reduction members 54 will extend across swimming pool 12, and will be spaced above the pool water when disposed in their operative position.

When ends 48 of supporting poles 46 are inserted into socket members 42 of respective pairs of pool cover brackets 28 oppositely mounted to each other on sidewall 14, supporting poles 46 will form an arcuate or cambered structure or framework over swimming pool 12 that is maintained under tension in that shape because supporting poles 46 will generally be longer in their linear extension than the diameter or greatest lengthwise distance of any swimming pool to which the are mounted. This manner of disposing supporting poles 46 to their operative position will produce a lateral force directed against the upper end of sidewall 14. In addition, over time a significant amount of snow and other debris may accumulate on pool cover 26, and this snow and debris will perforce load the supporting poles 46 creating a generally horizontally directed force that will continuously push against the upper end of sidewall 14. If this force is sufficiently strong and prolonged the seams along which portions of sidewall 14 are attached to one another may come apart compromising sidewall 14 integrity or the seams may fail and completely rupture causing enormous and costly damage to the swimming pool. Thus, the use of thrust reduction members 54 tends to counteract and relieve the lateral and horizontal force directed against sidewall 14 by preventing opposite portions of sidewall 14 from bulging outward to a point where the integrity of sidewall 14 would be threatened. Each thrust reduction member 54 may be an elongated metal pole or rod, although some type of flexible wire or cord would be preferable as it could be unrolled for usage and easily rolled and coiled up for storage.

Given the variety of above ground swimming pools available, there is no one preferred method or sequence of steps for disposing the above-described elements on swimming pool 12 to form pool cover assembly 10. The particular placement and spacing of pool cover brackets 28 on sidewall 14 will be dependent on the size and geometric configuration of the particular swimming pool 12. Moreover, the arrangement of pool cover brackets 28 on the various types of swimming pools shown in FIGS. 1, 6 and 7 are for illustrative purposes only, and many different arrangements are possible.

Whatever the particular spacing of brackets 28 on a swimming pool, each pool cover bracket 28 is placed on railing 20 so that lower surface 34 of base portion 30 is contiguous to railing 20 and distal end 40 of hook 36 can engage and catch onto interior lip 24 thereby securing pool cover bracket 28 to railing 20. Because supporting poles 46 are lightweight they can be easily guided and maneuvered into position so that ends 48 can be slidably inserted within cavities 44 of socket members 42. The length of each socket member 42 and the consequent depth of each cavity 44 is greater than the diameter of each supporting pole 46 in order provide variable entry points for pole ends 48 into cavities 44 so that the individual is not required to perfectly align each end 48 with cavity 44 before sliding the end therein. Also, the diameter of each cavity 44 should not be much greater than the diameter of each supporting pole 46 so that a snug fit occurs when ends 48 of supporting poles 46 are inserted into cavities 44.

Because each supporting pole 46 will assume an arched or cambered disposition when secured to the respective pairs of oppositely mounted brackets 28, the insertion of ends 48 of each supporting pole 46 into cavities 44 will cause a continuous lateral and downwardly directed force to be exerted against that pair of brackets 28. This lateral and downwardly directed force actually helps to maintain the stationary location of pool cover brackets 28 on railing 20.

At some point, either before or after supporting poles 46 are secured to pool cover brackets 28, at least one thrust reduction member 54 can be secured to rings 45 of one pair of oppositely mounted brackets 28. The number of thrust reduction members 54 used is dependent on the diameter and geometrical configuration of the particular swimming pool. Thus, larger pools may need or require more thrust reduction members 54 insofar as the force directed against the upper end of sidewall 14 will be greater because more brackets 28 and supporting poles 46 will be deployed about the swimming pool.

Furthermore, since a larger and heavier amount of snow and debris will be able to accumulate on the larger-sized pool cover, thus engendering a greater horizontal load against the upper end of the sidewall of that swimming pool, the use of several thrust reduction members 54 may be necessary.

Illustrated in FIG. 1 is a pole midpoint securement means for tying and holding poles 46 together at the peak of their camber or arch. This may be especially useful where a number of supporting poles 46 crisscross, underlap, or overlap one another as they span a large swimming pool. The midpoint securement means will assist in maintaining supporting poles 46 in their stationary arched disposition both above and across the swimming pool. For example, the midpoint securement means can be a rope, cord, bungee cord or a simple, lightweight mechanical device such as a catch or dog.

After brackets 28 are mounted to railing 20, and each flexible supporting pole 46 has ends 48 slidably inserted into cavities 44 of respective socket members 42 creating the cambered framework over pool 12, pool cover 26 can be placed on supporting poles 46 and spread over supporting poles 46 for covering the entire pool 12. The peripheral edge of pool cover 26 can then be pulled outwardly past each bracket 28 and then down past exterior lip 22 of railing 20. Pool cover 26 will typically include drawstring 56, such as a flexible elastic cord, that is enclosed within a channel or slot that extends about the periphery of pool cover 26 or retained by grommets spaced about the periphery of pool cover 26. Drawstring 56 can then be tightened by a conventional means, such as hand operable ratchet 58, and as drawstring 56 tightens the peripheral edge of pool cover 26 is tautly drawn up under exterior lip 22 of railing 20. This tightening action firmly secures pool cover 26 in position on the cambered framework defined by supporting poles 46 and about sidewall 14 of swimming pool 12.

The foregoing is considered as illustrative only of the principles of the invention. Since numerous modifications and changes will readily occur to those skilled in the art, it is not desired to limit the invention to the construction shown and described. Accordingly, all suitable modifications and equivalents may be resorted to falling within the scope of the invention.

The embodiments of the invention in which an exclusive property or privilege is claimed are defined as follows:

1. A removable pool cover assembly for supporting a pool cover above a swimming pool having a sidewall, a railing mounted on the sidewall, and the railing having an inner lip, the pool cover assembly, comprising:

a plurality of pool cover support members for removable mounting to the railing and each pool cover support member including:

a platform portion for placement onto the railing so that the platform portion is disposed perpendicular to the sidewall;

a hook integrally formed from the platform portion and extending downwardly therefrom;

the hook having a distal, curvilinear end for engaging the inner lip of the railing;

a socket member extending upwardly from, and at an acute angle to, the platform portion, and the socket member including an upwardly opening cavity;

a ring attached to the platform portion adjacent the hook; and, a plurality of flexible pool cover supporting poles with each pole having opposed socket insertion ends so that the socket insertion ends of each pole can be slidably inserted into the cavities of socket members of each respective pair of pool cover support members mounted opposite to one another on the sidewall thereby permitting the poles to span the swimming pool in order to form a cambered framework there over so that the pool cover can be disposed on the cambered framework for covering the swimming pool.

2. The pool cover assembly of claim 1 wherein the platform portion includes an upper surface and an opposite lower surface.

3. The pool cover assembly of claim 2 wherein the length of each socket member is greater than the diameter of the pool cover supporting poles.

4. The pool cover assembly of claim 3 wherein the diameter of the cavities of the socket members is greater than the diameter of each pool cover supporting pole.

5. The pool cover assembly of claim 4 wherein each pool cover supporting pole includes a plurality of interconnected links that can be arranged for arcuate extension to span the swimming pool.

6. The pool cover assembly of claim 5 wherein the links of each pool cover supporting pole can be disposed in side-by-side relationship for transport and storage.

7. The pool cover assembly of claim 6 further comprising a plurality of elongated thrust reduction members with each thrust reduction member having opposed ring ends for securement to the rings of the pool cover support members.

8. The pool cover assembly of claim 7 wherein opposed ring ends of each thrust reduction member are secured to the respective rings of one pair of pool cover support members that are mounted on the railing opposite to one another in order to lessen the outwardly directed thrust of the respective pool cover support members against the sidewall of the swimming pool.

9. A pool cover assembly for supporting a pool cover above a swimming pool having a sidewall surmounted by a railing having an inner lip, the pool cover assembly, comprising;

a plurality of pool cover brackets with each bracket spaced about the railing for removable securement thereto;

each pool cover bracket including a base portion for placement on the railing, an integrally formed hook extending downwardly from the base portion for engaging the inner lip, a socket member projecting upwardly from the base portion at an acute angle and the socket member having a cavity, and a ring that is attached to the hook;

a plurality of flexible pool cover support beams with each beam having opposed socket insertion ends that can be slidably inserted into each respective cavity of one pair of brackets that are secured on the railing opposite to each other whereupon the socket insertion ends thrust against each respective bracket causing each beam to form a cambered structure above the swimming pool for supporting the pool cover thereabove; and, a plurality of elongated thrust reduction members with each thrust reduction member having opposed ring attachment ends that are securable to the rings of the brackets in order to reduce the outwardly directed thrust of the brackets against the sidewalls by tending to slightly pull each pair of brackets that are mounted on the railing opposite of one another toward each other.

10. The pool cover assembly of claim 9 wherein the base portion includes an upper surface and an opposite lower surface.

11. The pool cover assembly of claim 10 wherein each socket member extends upwardly from the base portion at an acute angle.

12. The pool cover assembly of claim 11 wherein the diameter of each cavity of each socket member is at least equal to the diameter of each support beam.

13. The pool cover assembly of claim 12 wherein the depth of each cavity of each socket member is greater than the diameter of each support beam.

14. The pool cover assembly of claim 13 wherein each pool cover support beam includes a plurality of interconnected links that are capable of arcuate disposition between pairs of brackets mounted opposite to one another on the railing in order to extend therebetween to span the swimming pool.

15. The pool cover assembly of claim 14 wherein the links of each pole cover support beam are capable of collapsible disposition into a side-by-side relationship in order to facilitate storage and transport.

16. The pool cover assembly of claim 15 wherein each thrust reduction member includes a cable that is securable to the rings of one pair of brackets that are mounted on the railing opposite to each other.

17. The pool cover assembly of claim 16 wherein each thrust reduction member includes a flexible metal cable that is securable to the rings of one pair of brackets that are mounted on the railing opposite to each other.

18. A pool cover assembly for mounting to the inner lip of the railing of a sidewall of a swimming pool to support a pool cover above and around the swimming pool, the pool cover assembly, comprising:

a plurality of sidewall brackets disposed in spaced relationship about the sidewall for removable mounting thereto;

a plurality of pool cover support poles for attachment to the sidewall brackets wherein each support pole is slidably connected to one pair of sidewall brackets that are secured to the sidewall opposite of each other so that the support poles can span the swimming pool;

each support pole including a plurality of interconnected segmented members that are capable of being arranged in a flexible, arcuate extension for spanning the swimming pool; and, a plurality of elongated thrust reduction members with each thrust reduction member being attached to one pair of sidewall brackets disposed opposite to each other on the sidewall in order to lessen the outward thrust of the brackets against the sidewall when the poles are insertably connected to the brackets for forming an arcuate framework above the swimming pool.

19. The pool cover assembly of claim 18 wherein each sidewall bracket includes a base portion having an upper surface and an opposite lower surface with the lower surface being superposed on the railing when the bracket is secured to the sidewall of the swimming pool.

20. The pool cover assembly of claim 19 wherein each bracket includes a socket member that projects upwardly from the upper surface at an acute angle.

21. The pool cover assembly of claim 20 wherein each bracket includes a hook that projects downwardly from the lower surface of the base portion in order to releasably engage to the inner lip.

22. The pool cover assembly of claim 21 wherein each socket member includes an upwardly opening cavity having a diameter that is greater than the diameter of each support pole so that each support pole can be slidably inserted into the cavity.

23. The pool cover assembly of claim 22 wherein the depth of each cavity of each socket member is at least equal to the diameter of each support pole so that each respective support pole can be slidably received therein.

24. The pool cover assembly of claim 23 wherein each sidewall bracket includes a ring attached to the hook adjacent the lower surface and which projects away from the inner lip when the bracket is mounted to the railing.

25. The pool cover assembly of claim 24 further comprising a plurality of sidewall thrust reduction members with each sidewall thrust reduction member having opposed ends that are securable to the rings of one pair of brackets that are mounted on the railing opposite to each other on the sidewall for lessening the outward thrust of the supporting poles against the sidewall when the brackets are mounted to the railing and the supporting poles are inserted into the cavities of the socket members for spanning the swimming the pool.

* * * * *